US012163199B2

(12) United States Patent
Liu et al.

(10) Patent No.: US 12,163,199 B2
(45) Date of Patent: Dec. 10, 2024

(54) METHOD FOR MANUFACTURING A 5NI STEEL PLATE WITH A LOW REMANENCE AND AN EXCELLENT SURFACE QUALITY TO BE USED IN A SHIP

(71) Applicant: Jiangyin Xingcheng Special Steel Works Co., Ltd, Jiangyin (CN)

(72) Inventors: Zhaoxia Liu, Jiangyin (CN); Xiaohong Xu, Jiangyin (CN); Yun Bai, Jiangyin (CN); Pifeng Miao, Jiangyin (CN); Jun Liu, Jiangyin (CN); Buqiang Han, Jiangyin (CN); Yonghao Zhou, Jiangyin (CN); Jinming Wu, Jiangyin (CN); Jun Gao, Jiangyin (CN); Guozhong Li, Jiangyin (CN); Menglong Di, Jiangyin (CN); Yu Meng, Jiangyin (CN); Shuquan Liao, Jiangyin (CN); Sha Lu, Jiangyin (CN); Liang Gao, Jiangyin (CN)

(73) Assignee: Jiangyin Xingcheng Special Steel Works Co., Ltd, Jiangyin (CN)

( * ) Notice: Subject to any disclaimer, the term of this patent is extended or adjusted under 35 U.S.C. 154(b) by 0 days.

(21) Appl. No.: 18/245,337

(22) PCT Filed: Jan. 7, 2021

(86) PCT No.: PCT/CN2021/070624

§ 371 (c)(1),
(2) Date: Mar. 14, 2023

(87) PCT Pub. No.: WO2021/196820

PCT Pub. Date: Oct. 7, 2021

(65) Prior Publication Data

US 2024/0344160 A1 Oct. 17, 2024

(30) Foreign Application Priority Data

Mar. 30, 2020 (CN) ..... 202010233834.2

(51) Int. Cl.

| | |
|---|---|
| ***C21D 8/02*** | (2006.01) |
| ***C21D 1/19*** | (2006.01) |
| ***C21D 9/46*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |

(52) U.S. Cl.

CPC ..... *C21D 8/0226* (2013.01); *C21D 1/19* (2013.01); *C21D 8/0205* (2013.01); *C21D 8/0273* (2013.01); *C21D 9/46* (2013.01); *C22C 33/04* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01)

(58) Field of Classification Search

None

See application file for complete search history.

(56) References Cited

FOREIGN PATENT DOCUMENTS

| | | | | |
|---|---|---|---|---|
| CN | 102330031 | A | * | 1/2012 |
| CN | 103374681 | A | | 10/2013 |
| CN | 103509999 | A | | 1/2014 |
| CN | 104195428 | A | | 12/2014 |
| CN | 104388838 | A | | 3/2015 |
| CN | 104583439 | A | | 4/2015 |
| CN | 111440990 | A | | 7/2020 |
| JP | 5494166 | B2 | | 5/2014 |

OTHER PUBLICATIONS

PCT/CN2021/070624—International Search Report and Written Opinion mailed on Mar. 25, 2021, 19 pages.

* cited by examiner

*Primary Examiner* — Anthony M Liang

(74) *Attorney, Agent, or Firm* — Getech Law LLC; Jun Ye

(57) ABSTRACT

Disclosed is a method for manufacturing a 5Ni steel plate with a low remanence and an excellent surface quality to be used in a ship. The process flow thereof comprises: converter smelting→LF refining→RH high vacuum degassing→treatment with Ca→continuous casting→a slow cooling treatment to the slab→cleaning the surface of the slab→heating→rolling→quenching twice→tempering. The constituents comprise a low content of carbon, a low content of silicon, and 5% Ni, with V and Nb being added thereto, which improves the hardenability, improves the toughness at a low temperature, and improves the starting temperature of non-recrystallization of austenite. The steel plate can be subjected to high-temperature rolling and high-temperature quenching so as to significantly improve the shape of the plate, thus being applicable to the production of thin products.

7 Claims, 2 Drawing Sheets

METHOD FOR MANUFACTURING A 5NI STEEL PLATE WITH A LOW REMANENCE AND AN EXCELLENT SURFACE QUALITY TO BE USED IN A SHIP

TECHNICAL FIELD

The invention relates to a manufacturing method of a steel plate to be used in a ship, in particular to a manufacturing method of a 5Ni steel plate to be used in a ship.

BACKGROUND

Besides pipeline transportation, the most important way to transport liquefied petroleum gas (LPG) is by sea. Use ships to store LPG, transport LPG and liquefied ethylene (LEG) obtained through petroleum cracking and liquefaction. Such transporting ships are usually built by 5Ni steel with a high strength, a good toughness at low temperature and a high elongation. A 5Ni steel means that the Ni content in the steel reaches about 5%. Because a 5Ni steel has a high Ni content, has high requirements of surface quality, and requires a low participation of impurities, it puts forward higher requirements in smelting, rolling, heat treatment and other production processes. In addition, low remanence (residual magnetism) is also an important factor which restricts the mass production of 5Ni steel.

20) The patent publication CN104195428A discloses a low-carbon high-strength 5Ni steel plate containing V and its manufacturing method. In this method, an appropriate amount of V is added on the basis of low C content and about 5% Ni content. It obtains a 5Ni steel through two-stage controlled rolling and quenching and tempering heat treatment, and introduces the flatness of the steel plate. The thickness of the produced steel plate is between 25 mm and 50 mm. This method is not suitable for producing thinner steel plates. When the production thickness is reduced, it is difficult to ensure the flatness of the steel plate. The patent publication CN 102330031A discloses a method for manufacturing a steel with a high toughness at a low temperature of −130° C. In the method, Nb, Mo, Cr, Zr and RE are added. Nb and Mo are expensive metals, which significantly increase the cost of alloying raw materials. The addition of elements such as Zr and RE will significantly increase the difficulty of molten steel smelting. Thereby it is difficult to achieve a mass production. The patent publication CN104388838A discloses a 5Ni steel plate for pressure vessels at ultra-low temperature and its production method. The product thickness is 8-50 mm, the composition design is simplified. Controlled rolling and cooling, stacked cooling, and heat treatment comprising two times of quenching and tempering are adopted. Thereby, a 5Ni steel plate with high strength and toughness at a low temperature of down to −125° C. is obtained. In the method, the second stage of controlled rolling requires a starting rolling temperature of ≤850° C. and an ending rolling temperature of ≤810° C. After rolling, the semi-finished steel plate is water-cooled. The temperature of turning red during water cooling is less than or equal to 650° C. Because of the low starting temperature in the second stage of rolling and because of the water cooling after rolling, it is not conducive to the shape control of thin plates. The patent publication CN 105331890A discloses a method for producing a 5Ni steel plate having a medium or thick thickness and having a high toughness, by using on-line quenching. The method uses casting and cogging, rolling in two stages, on-line quenching to the temperature of below 200° C., tempering at 590-620° C., so as to obtain a 5Ni steel plate with a mixed structure of tempered martensite with a small amount of reverse transformed austenite. Cogging has a good effect on the uniformity of the structure and properties of the steel plate, but it also significantly increases the production cost and prolongs the production process.

For 5Ni steel plates, surface quality and remanence (residual magnetism) are important supplying requirements, and the two requirements are also the two most important points among the supplying requirements to 5Ni steel which are different from the requirements to other steel types. Therein, the surface quality is an important factor which restricts the production of thin 5Ni steel plates.

CONTENT OF THE INVENTION

For 5Ni steel plates, especially thin 5Ni steel plates, we adopt a composition design with a low C content, 5% Ni, V+Nb micro-alloying, and a production method using slab peeling, hot rolling at high temperature, and no water cooling after rolling, then heat treatments of quenching twice+tempering, increasing the first quenching temperature, reducing the segregation caused by high Ni content, and using a vacuum suction cup to lift, so as to obtain 5Ni steel with a good toughness, an excellent surface quality and a low remanence.

The chemical constituents of the 5Ni steel of the present invention are by mass percentage, C: 0.07-0.10%, Si: 0.05-0.20%, Mn: 0.60-0.80%, Ni: 4.90-5.25%, P: ≤0.0070%, S: ≤0.0020%, Al: 0.010-0.035%, V: 0.010-0.015%, Nb: 0.010-0.020%, Ca: 0.0005-0.0030%, O: ≤0.0012%, N: ≤0.0040%, H: ≤0.00010%, the balance is Fe and inevitable impurity elements.

The analysis of respective element in the 5Ni steel for a ship according to the present invention is as follows:

The addition of C can increase the hardenability of steel, especially in the production of medium or thick plates, which can significantly improve the strength. However, too much C content is not conducive to the impact performance at an ultra-low temperature, the aging performance of ultra-low temperature strain, the welding performance and the corrosion resistance. Thus, the carbon content in the present invention is controlled to be 0.07-0.10%.

Si is used for deoxidation. Although its addition amount should be determined according to different smelting methods, it must be above 0.05% to obtain good performances of a steel plate. If it exceeds 0.30%, it is prone to form silicon-aluminum spinel in the oxide scale, which is difficult to remove. Considering that the surface quality of 5Ni steel is particularly important, the present invention uses a control of a low Si content with an upper limit of 0.20%.

Mn is an element that improves the hardenability of steel, and plays a role of strengthening solid solution, so as to compensate for the loss of strength caused by the reduction of C content in steel. When the Mn content in the steel is too low, it cannot fully play the role of ensuring strength. However, when the Mn content is too high, it will increase the carbon equivalent, and thus damage the welding performance. In addition, Mn tends to segregate at the center of the steel plate, which reduce the impact toughness at 20) the center of the steel plate. Therefore, the content of Mn in the present invention is controlled to be 0.60-0.80%.

Ni is an element that improves the hardenability of the steel plate and can significantly improve the toughness at a low temperature, and has a good influence on the impact toughness and the ductile-brittle transition temperature. However, when the Ni content is too high, the surface of the slab is prone to form oxide scale with high viscosity, which is difficult to remove and thus affects the surface quality of the steel plate. In addition, Ni is also an expensive metal, and an excessively high content will increase the cost. Therefore, the present invention controls its content to be 4.90-5.25%, on the premise of meeting the requirements of classification societies and international standards. It is beneficial to achieve an optimal cost performance.

Nb has a dragging effect on solute and Nb(C, N) has a pinning effect on austenite grain boundaries. Both of them inhibit the recrystallization of deformed austenite and expand the temperature range of austenite non-recrystallization. Thereby, a starting temperature of finish rolling can be increased, the shape of the steel plate can be guaranteed, a high-temperature finish rolling can be easily realized, the yield ratio of the steel plate can be reduced, and the temperature range forming secondary oxide scales can be avoided. However, too much Nb will lead to the formation of fine grains in the steel plate, and increase the yield ratio. Thus, the present invention controls its content to be within a narrow range of 0.010-0.020%.

V is an element which strongly forms carbide and nitride, and forms second phase particles such as VC and V(CN) in steel, which can refine grains and improve the strength of the steel and toughness at a low temperature. However, when the content of V is too high, it will reduce the weldability of steel. Thus, its content is controlled to be 0.010-0.015%.

Ca treatment is a necessary treatment for the steel of the present invention. 0.0005-0.0030% Ca can not only reduce the hazards caused by sulfides, but also can change sharp $Al_2O_3$ inclusions into spherical inclusions having a lower melting point, thereby reduce the generation of micro-cracks at sharp corners of hard inclusions during the rolling of the steel plate, and thus improve the impact toughness of the steel plate.

Although P can improve corrosion resistance, it will reduce toughness at a low temperature and affect the weldability of steel plates, which is not suitable for structural steel. In the present invention, it is controlled to be below 0.0070%.

S forms MnS inclusions, and also leads to center segregation, and has adverse effects on corrosion resistance. In the present invention, it is controlled to be below 0.0020%.

Al plays the role of nitrogen fixation and deoxidation. The AlN formed by the joint of Al and N can effectively refine the grains. However, if the content is too high, the toughness of the steel will be damaged. Therefore, the present invention controls its content (Al) to be 0.010-0.035%.

O, N: Harmful gas elements. When the content is high, it generates more inclusions, which will reduce the plasticity, toughness and welding bending properties of the steel plate. The present invention strictly controls the O content not higher than 0.0012%; the N content not higher than 0.0040%.

H: Harmful gas element. When the H content is high, it is prone to generate white spots, thereby reducing the plasticity and toughness of the steel plate, and seriously endangering the performance of the steel plate. In order to improve the comprehensive performance of the steel plate, the present invention strictly controls the H content within 0.00010%.

A method for manufacturing a 5Ni steel plate according to the present invention, contains the processes as follows.

Smelting and continuous casting process: raw materials for smelting are smelted successively by converter, RH refining, and LF refining. In order to control the internal porosity and segregation of the steel plate, we use the casting at a low superheat. The superheat of casting is controlled to be 5-25° C. The whole casting process is protected by argon gas and is controlled by dynamic soft reduction; so as to ensure that a center segregation of the slab is not higher than C1.0 grade.

Slow cooling and polishing of slabs: after the slab is moved off the assembly line, performing slow cooling treatment. The slab is stacked in a pit for slow cooling, or is covered for slow cooling. A starting temperature of slow cooling is not lower than 600° C., and the slow cooling lasts for no lower than 72 hours. After slow cooling, the surface of the slab is cleaned by polishing, wherein 1-2 mm thickness are polished away from both upper and lower surfaces. After polishing, a paint (a latex paint, which can withstand high temperatures) is applied as a coating. The purpose of the paint is to seal the surface of the slab, so as to prevent the slab from being exposed to air and being oxidized during reheating.

Heating process: the slab is sent into a step-by-step heating furnace with an average speed of 10-14 cm/min. Heating to 1170-1220° C. When a core temperature of the slab reaches a surface temperature of the slab, starting the heat preservation, and the heat preservation lasts for no less than 0.5 hour. It makes the alloying elements in the steel fully dissolved, so as to ensure the uniformity of the constituents and the uniformity of properties of the final product.

Rolling process: after the slab is moved out of the furnace, perform descaling by using high-pressure water, and controlled rolling in two stages: rough rolling+finish rolling, a starting temperature of rough rolling is between 1080 to 1150° C., a reduction rate in each pass of the last three passes of the rough rolling is ≥15%, a thickness of an intermediate product is ≥1.8H, wherein H is the thickness of a finished steel plate. High-temperature rolling is used for finishing rolling, wherein a starting temperature of rolling is 880-970° C., an ending temperature of rolling is not lower than 800° C. After rolling, air-cooling is used, and water-cooling cannot be used.

Quenching heat treatment process: a first quenching is performed at a temperature of 880±10° C., a holding time after the furnace temperature reaches the desired temperature is 30-100 min, quenching by water. A second quenching is performed at a temperature of 760±10° C., a holding time after the furnace temperature reaches the desired temperature is 30-100 min, quenching by water. In order to ensure the uniformity of the steel plate, the accuracy of temperature control is ±10° C.

Tempering heat treatment process: after quenching, the tempering is performed at a temperature of 630±10° C.; after the core of the steel plate reaches the desired temperature, keep the temperature for 120-200 min, so that the carbon in the quenched martensite is fully diffused, and a micro structure of tempered sorbite is obtained. It ensures the matching of the strength and toughness of the steel plate, and improves the engineering applicability of the steel plate.

The steel plate after tempering is the finished steel plate, and the product should be hoisted by vacuum, and the performance will be tested by sampling after tempering.

Compared with the prior arts, the present invention has the following advantages.

(1) We use a low content of carbon, 5% Ni, and add an appropriate amount of V, to ensure the hardenability of the steel plate, increase the tensile strength of the steel plate, and ensure the impact toughness of the steel plate at a low temperature of −130° C. to −150° C. We add an appropriate amount of Nb, to improve a starting temperature of austenite non-recrystallization. We process a high-temperature rolling on steel plates, especially a high-temperature finish rolling, so as to ensure the shape of steel plates, especially thin steel plates.

(2) The present invention uses a low content of Si, high-temperature rolling, polishing on the upper and lower surfaces of the slab, surface coating, and high-pressure water descaling, which help to improve the surface quality of the steel plate.

(3) The invention ensures the good shape of the 5Ni steel plate by adding Nb, stepwise heating control, high-temperature rolling, and air cooling (no water cooling) after rolling. It also prevents scratches on the steel plate caused by straightening, which helps to protect the surface quality of the steel plate.

(4) Although the austenite-ferrite transformation point of 5Ni steel is much lower than other steel products, the present invention increases the first quenching temperature to 880±10° C. in the heat treatment process, in order to make the production together with other types of steels. Thus, there is no need to largely increase or decrease the temperature of the heat treatment furnace in large-scale production. Increasing the first quenching temperature also helps to modify the segregation degree of steel which has a high Ni content.

The method of manufacturing 5Ni steel plate of the present invention can produce a steel plate with a thickness of 6-50 mm, a yield strength of ≥520 MPa, a tensile strength of 620-645 MPa, a yield ratio of ≤0.82, an elongation of ≥26%, and an impact toughness of ≥200 J at −130° C.; excellent surface quality: reaching a level of SA 2.0. The average remanence (residual magnetism) at corners of the steel plate is ≤15 Guass. When ultrasonic flaw detection is carried out according to standard EN 10160, a body area of the plate meets the requirements of Class S3, and an edge area meets the requirements of Class E4. The structure of the steel plate is a uniform tempered sorbite structure, which is suitable for mass production.

DETAILED EMBODIMENTS

Figure 1:
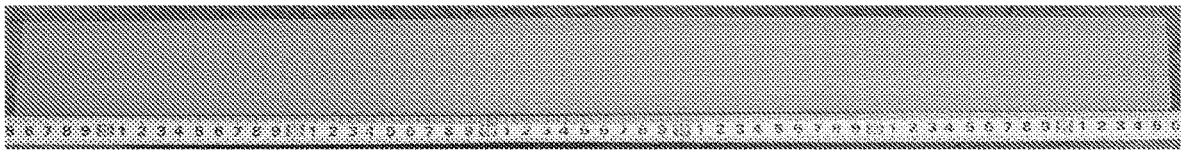
FIG. 1 is a low-magnification photo of the test steel plate of Example 4, showing that the central segregation caused by continuous casting has been significantly reduced.

The present invention is further described in detail in conjunction with examples.

The production process of a 5Ni steel plate to be used in a ship comprises: converter smelting→LF refining→RH high-vacuum degassing→Ca treatment→continuous casting→slow cooling of slab→cleaning of slab surface→heating→rolling→quenching twice→tempering, including the following steps:

(1) Smelting: using high-quality raw materials, smelting in a 150-ton converter, RH high-vacuum degassing treatment, refining in a LF furnace, breaking vacuum, Ca treatment, and then RH vacuum degassing. The alloy components of Examples 1-4 are listed in Table 1.

(2) Continuous casting: casting molten steel into a continuous casting slab with a thickness of 150 mm, the casting temperature is controlled to be 5-25° C. above the liquidus temperature. The whole casting process is protected by argon gas and is controlled by dynamic soft reduction. The process parameters for continuous casting are listed in Table 2. A casting slab with a center segregation of no higher than C1.0 grade is taken as a qualified slab.

(3) Slow cooling of slabs: the continuous casting slabs are placed in a pit, stacked, and slowly cooled, to diffuse the hydrogen. A starting temperature of slow cooling is ≥600° C., and the slow cooling lasts for 72 hours. The starting temperature and the time of slow cooling are listed in Table 2. After slow cooling, using a machine to polish and clean the surface of the slab, wherein 1.5 mm thickness are polished away from both upper and lower surfaces, and then a coating (a latex paint, which can withstand high temperatures) is applied, so as to block air, and to prevent oxidation before reheating.

(4) Reheating: putting the slab obtained from the step (3) into a step-by-step heating furnace, at an average speed of 10-14 cm/min; heating to 1180-1250° C.; when a core temperature of the slab reaches a surface temperature of the slab, starting the heat preservation, the heat preservation lasts for more than 1 hour. Thereby, the alloying elements in the steel can be fully in solid solution, which ensures the uniformity of the composition and the uniformity of performance of the final product. Besides, a period of heating at 600-900° C. is controlled to be ≥0.32 min/mm;

(6) Rolling: after the slab is moved out of the furnace, descaling by using high-pressure water, and rolling in two stages: rough rolling+finish rolling, a starting temperature of rough rolling is between 1080 to 1150° C., a reduction rate in each pass of the last three passes of the rough rolling is ≥15%, a thickness of an intermediate product is ≥1.8H, wherein H is the thickness of a finished steel plate. High-temperature rolling is used for finishing rolling, wherein a starting temperature is 880-970° C., an ending temperature is ≥ 800° C. After the rolling is completed, the steel plate is not subjected to an accelerated water cooling by an ACC unit, but to air cooling. The process parameters for the rolling stage are shown in Table 3.

(7) Quenching: a first quenching is performed at a temperature of 880±10° C., a holding time after the furnace temperature reaches the temperature is 30-100 min; a second quenching is performed at a temperature of 760±10° C., a holding time after the furnace temperature reaches the temperature is 30-100 min; the quenching medium is water.

(8) Tempering: the tempering is performed at a temperature of 630±10° C.; with a holding time of 120-200 min.

(9) After the steel plate is quenched twice and tempered, it is hoisted by a vacuum suction cup and stacked separately.

(10) The tempered steel plate is subjected to transverse tensile tests and transverse impact tests, and the remanence (residual magnetism) and the surface quality of the steel plate are measured.

The element constituents and process parameters of Examples 1-4 are shown in Tables 1-3. The tested performance of the products produced by respective Example is shown in Table 4.

FIG. 1 shows a low-magnification photo of the test steel plate of Example 4, showing that the central segregation caused by continuous casting has been significantly reduced.

Figure 2:
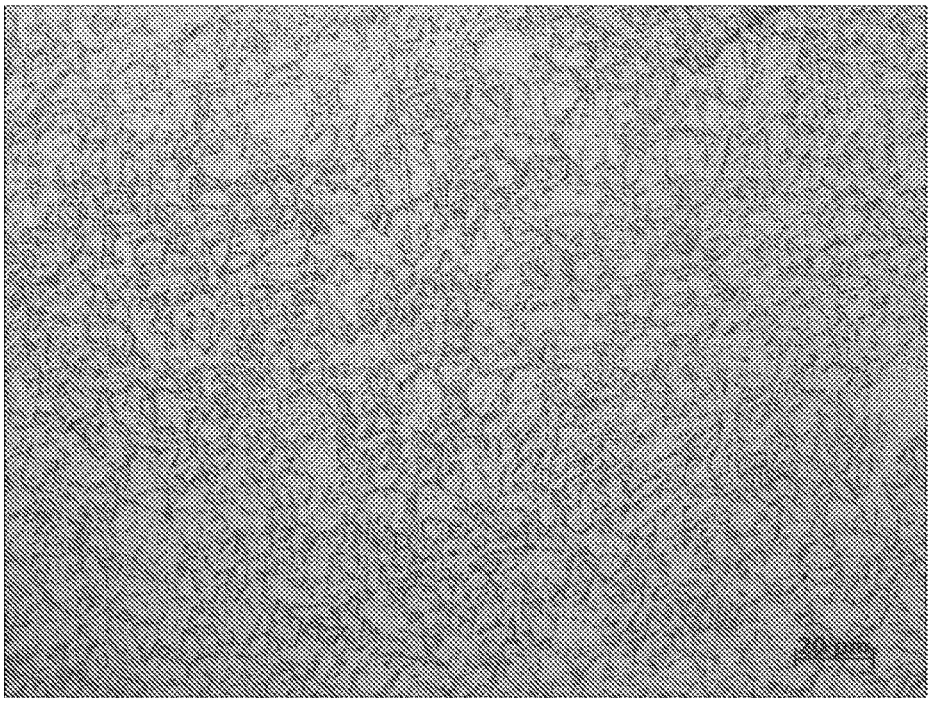
FIG. 2 is the metallographic structure at ¼ thickness of the test steel in Example 1 of the present invention, showing a tempered sorbite structure.
Figure 3:
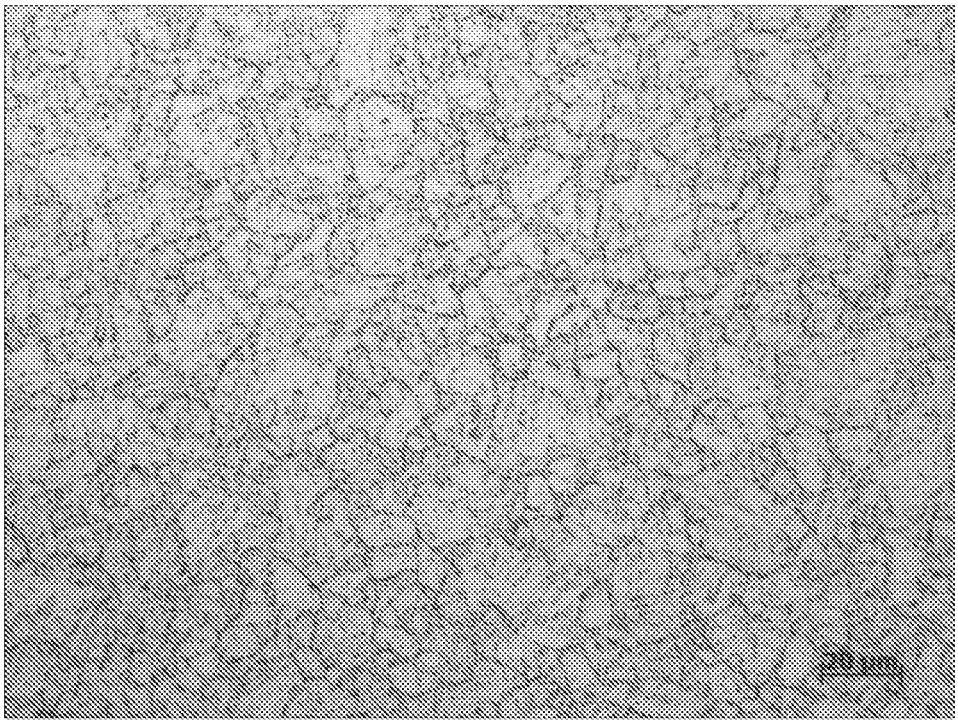
FIG. 3 is the metallographic structure at ¼ thickness of the test steel in Example 4 of the present invention, showing a tempered sorbite structure.

FIGS. 2 and 3 are microstructure photos at ¼ thickness of the test steel in Examples 1 and 4. The microstructure of the finished steel plate is tempered sorbite.

The present invention uses a controlled rolling at high temperature and an off-line quenching+tempering process, and controls the design of chemical composition, the process, the structure of base material, the center segregation, the temperature and time in quenching and tempering, etc. While realizing a 5Ni steel plate with high strength, we also ensure that the steel plate has a good elongation, an impact toughness at a low temperature of −130° C., an excellent surface quality and a low remanence.

The invention claimed is:

1. A method for manufacturing a 5Ni steel plate with a low remanence and an excellent surface quality to be used in a ship, comprising following steps:

(1) smelting of molten steel: chemical constituents by mass percentage, C: 0.07-0.10%, Si: 0.05-0.20%, Mn: 0.60-0.80%, Ni: 4.90-5.25%, P: ≤0.0070%, S: ≤0.0020%, Al: 0.010-0.035%, V: 0.010-0.015%, Nb: 0.010-0.020%, Ca: 0.0005-0.0030%, O: ≤0.0012%, N: ≤0.0040%, H: ≤0.00010%, the balance is Fe and inevitable impurity elements;

TABLE 1

Chemical constituents of the super-strong steel plate in the Examples (wt %)

| | C | Si | Mn | P | S | Ni | Nb | V | Al | Ca | O | N | H |
|---|---|---|---|---|---|---|---|---|---|---|---|---|---|
| 1 | 0.09 | 0.16 | 0.73 | 0.006 | 0.001 | 5.07 | 0.0145 | 0.0145 | 0.025 | 0.0009 | 0.0009 | 0.00189 | 0.0001 |
| 2 | 0.09 | 0.16 | 0.73 | 0.006 | 0.001 | 5.08 | 0.0160 | 0.0110 | 0.025 | 0.0012 | 0.0007 | 0.00171 | 0.0001 |
| 3 | 0.09 | 0.16 | 0.75 | 0.007 | 0.001 | 5.14 | 0.0134 | 0.0134 | 0.021 | 0.0016 | 0.0010 | 0.00185 | 0.0001 |
| 4 | 0.09 | 0.16 | 0.76 | 0.008 | 0.001 | 5.21 | 0.0183 | 0.0134 | 0.021 | 0.0016 | 0.0008 | 0.00191 | 0.0001 |

TABLE 2

Control of continuous casting process

| Example | thickness of slab mm | superheat ° C. | dynamic soft reduction fs | starting temperature of slow cooling ° C. | time of hydrogen diffusion hour |
|---|---|---|---|---|---|
| 1 | 150 | 23 | 0.35-0.95 | 700 | 72 |
| 2 | 150 | 18 | 0.35-0.95 | 690 | 72 |
| 3 | 150 | 16 | 0.35-0.95 | 680 | 72 |
| 4 | 150 | 14 | 0.35-0.95 | 700 | 72 |

(2) continuous casting: casting molten steel into a continuous casting slab, the superheat of casting is controlled to be 5-25° C., and the casting slab with a center segregation of no higher than C1.0 grade is taken as a qualified slab;

(3) cooling and polishing of the slab: after the slab is moved off an assembly line, performing cooling treatment, a starting temperature of cooling is not lower than 600° C., and the cooling lasts for no lower than 72 hours; after cooling, polishing and cleaning both upper and lower surfaces of the slab, wherein 1-2 mm thickness are polished away from both upper and lower

TABLE 3

Control of rolling process

| Example | thickness of product mm | tapping temperature for the slab ° C. | reduction rates in the last three passes of the rough rolling | thickness of an intermediate product mm | starting temperature of finishing rolling ° C. | ending temperature of finishing rolling ° C. |
|---|---|---|---|---|---|---|
| 1 | 12 | 1220 | 23% + 27% + 26% | 26 | 887 | 805 |
| 2 | 16 | 1210 | 22% + 25% + 26% | 32 | 905 | 813 |
| 3 | 30 | 1230 | 16% + 17% + 16% | 60 | 963 | 840 |
| 4 | 50 | 1220 | 15% + 14% + 14% | 90 | 880 | 825 |

TABLE 4

Transverse tensile, transverse impact property and remanence in the Examples of the present invention

| Example | Thickness mm | Stretching | | | | Impact energy AKv, J | | | | Average remanence at four corners of the steel plate, Guass |
|---|---|---|---|---|---|---|---|---|---|---|
| | | Yield strength MPa | Tensile strength MPa | Elongation % | Yield strength ratio | | | | | |
| 1 | 12 | 534 | 645 | 26.0 | 71 | −130° C. | 268 | 278 | 285 | 13 |
| 2 | 16 | 525 | 625 | 27.0 | 82 | −130° C. | 283 | 241 | 281 | 8 |
| 3 | 32 | 535 | 625 | 26.0 | 81 | −130° C. | 262 | 292 | 257 | 9 |
| 4 | 50 | 520 | 620 | 27.5 | 82 | −130° C. | 289 | 278 | 257 | 8 |

surfaces, and then a coating is applied on both upper and lower surfaces, so as to block air, and to prevent oxidation when reheating;

(4) reheating: heating to 1170-1220° C., wherein a period of heating at 600-900° C. is controlled to be ≥0.32 min/mm; when a core temperature of the slab reaches a surface temperature of the slab, starting a timer for heat preservation, the heat preservation lasts for no less than 0.5 hour;

(5) hot rolling: after the slab is moved out of a furnace, descaling by using high-pressure water, and rolling in two stages: rough rolling+finish rolling, a starting temperature of rough rolling is between 1080 to 1150° C., a reduction rate in each pass of the last three passes of the rough rolling is ≥15%, a thickness of an intermediate product is ≥1.8H, wherein H is the thickness of a finished steel plate; high-temperature rolling is used for finishing rolling, wherein a starting temperature is 880-970° C., an ending temperature is ≥800° C., rolling to a target thickness; after rolling, air-cooling the steel plate;

(6) quenching heat treatment process: a first quenching is performed at a temperature of 880±10° C., a holding time after a furnace temperature reaches the temperature is 30-100 min, quenching by water; a second quenching is performed at a temperature of 760±10° C., a holding time after the furnace temperature reaches the temperature is 30-100 min, quenching by water;

(7) tempering heat treatment process: the tempering is performed at a temperature of 630±10° C.; after a position located at ½ thickness of the steel plate reaches the temperature, keep the temperature for 120-200 min, so that the carbon in the quenched martensite is fully diffused, and a micro structure of tempered sorbite is obtained, wherein the finished steel plate reaches a surface quality of SA 2.0, an average remanence at corners of the steel plate is ≤15 Guass; when ultrasonic flaw detection is carried out according to standard EN 10160, a body area of the plate meets the requirements of Class S3, and an edge area meets the requirements of Class E4; wherein the steel plate has a yield strength of ≥520 MPa, a tensile strength of 620-645 MPa, a yield ratio of ≤0.82, an elongation of 26%, and an impact toughness of ≥200 J at −130° C.; the structure of the steel plate is mainly unfirm tempered sorbite.

2. The method for manufacturing a 5Ni steel plate with a low remanence and an excellent surface quality to be used in a ship according to claim 1, wherein the method is suitable to produce a 5Ni steel plate with a thickness of 6-50 mm.

3. The method for manufacturing a 5Ni steel plate with a low remanence and an excellent surface quality to be used in a ship according to claim 1, wherein the step (1) smelting of molten steel includes converter smelting, RH refining, LF refining.

4. The method for manufacturing a 5Ni steel plate with a low remanence and an excellent surface quality to be used in a ship according to claim 1, wherein in the step (2), the whole process of casting molten steel is protected by argon gas and is controlled by dynamic soft reduction.

5. The method for manufacturing a 5Ni steel plate with a low remanence and an excellent surface quality to be used in a ship according to claim 1, wherein the cooling in step (3) requires the slab to be stacked in a pit or to be covered.

6. The method for manufacturing a 5Ni steel plate with a low remanence and an excellent surface quality to be used in a ship according to claim 1, wherein in the step (4) a step-by-step heating furnace is used to heat the slab with an average speed of 10-14 cm/min.

7. The method for manufacturing a 5Ni steel plate with a low remanence and an excellent surface quality to be used in a ship according to claim 1, wherein after the steel plate is tempered, it is hoisted by a vacuum suction cup and stacked separately.

* * * * *